United States Patent [19]

McCarry

[11] 4,396,313

[45] Aug. 2, 1983

[54] METHOD OF FORMING FLOORING IN TUNNELS

[75] Inventor: Dennis C. McCarry, Gilroy, Calif.

[73] Assignee: Guy F. Atkinson Company, South San Francisco, Calif.

[21] Appl. No.: 169,983

[22] Filed: Jul. 18, 1980

[51] Int. Cl.[3] ..... E21D 11/08

[52] U.S. Cl. ..... 405/150; 238/10 R; 405/146; 405/132

[58] Field of Search ..... 405/141, 144, 145, 146, 405/147, 150, 151, 132; 238/10 R; 104/2

[56] References Cited

U.S. PATENT DOCUMENTS

| | | | |
|---|---|---|---|
| 3,138,327 | 6/1964 | Jacobs | 238/10 R |
| 3,365,895 | 1/1968 | Jacobs | 238/10 R |
| 3,404,920 | 10/1968 | Tabor | 405/141 X |
| 3,650,116 | 3/1972 | Cunningham | 405/144 |
| 3,905,645 | 9/1975 | Bland | 405/146 X |
| 3,990,746 | 11/1976 | Foik et al. | 405/146 X |

*Primary Examiner*—Dennis L. Taylor

*Attorney, Agent, or Firm*—Flehr, Hohbach, Test, Albritton & Herbert

[57] ABSTRACT

A method for providing a flooring in a tunnel using a moving floor is disclosed herein. This method includes providing the moving floor with a flat, horizontally extending support surface extending rearwardly therefrom at floor level and movable therewith, advancing the moving floor and support surface, and placing precast concrete floor slabs to extend across the tunnel on the excavated tunnel invert exposed by the moving floor whereby to provide flooring along the length of the tunnel, each of the slabs being initially placed, one at a time, onto the support surface and adjacent the previous slab while remaining on the surface, and thereafter from the surface onto the tunnel invert as the moving floor and support surface are advanced.

8 Claims, 9 Drawing Figures

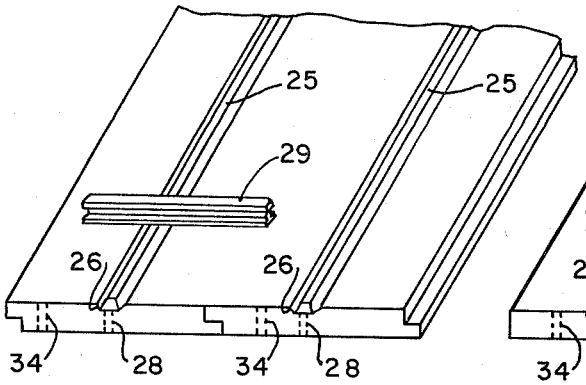
FIG.—5
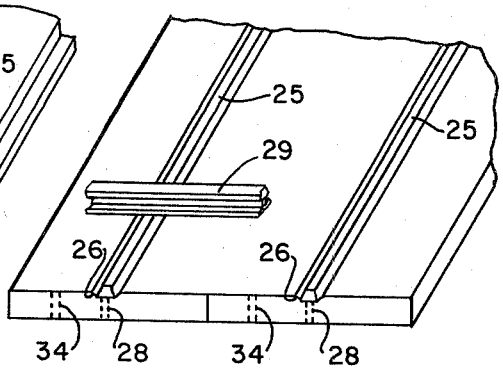
FIG.—6
FIG.—7
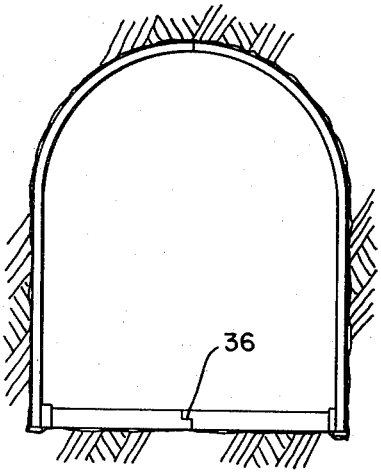
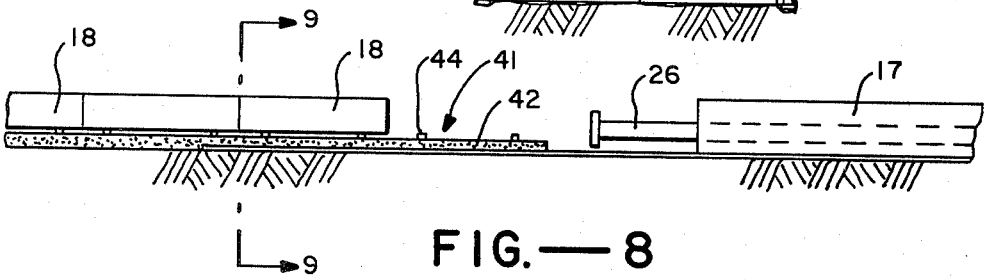
FIG.—8
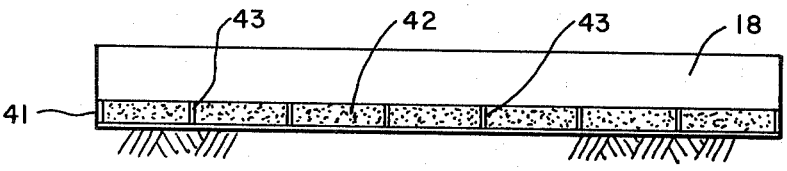
FIG.—9

METHOD OF FORMING FLOORING IN TUNNELS

This invention relates generally to a method for installing precast concrete invert slabs to form floors in tunnels serving to support equipment as the tunnel is constructed and struts for supporting the tunnel ribs.

As a tunnel is constructed, dirt, rocks and other materials are dislodged from the forward end by various methods including drilling and blasting. The dislodged dirt, rocks and materials must then be loaded into a suitable carrier and removed from the tunnel. In one type of tunneling the cars and other equipment are moved into and out of the tunnel along rails; in other types, the equipment is tire mounted. In any type of tunneling the equipment must be moved along the floor of the tunnel. If rails are used, they are mounted on ties mounted on the floor. Generally, working conditions within the tunnel are relatively poor because of the condition of the tunnel floor. Problems are encountered in keeping the tracks aligned and preventing movement in the support system on the rough tunnel floor.

During the construction of the tunnel, ribs or supports are spaced along the tunnel to support the tunnel walls and ceiling until the tunnel is completed. Struts are often required at the bottom of the U-shaped ribs or supports to hold them in place and prevent their moving inwardly under the pressure of the rocks and dirt forming the tunnel.

In U.S. Pat. No. 3,138,327 there is described an improved movable track for use in tunnel construction. More particularly, a track is shown and described which supports the tunneling equipment at the face of the tunnel and which can be advanced as the tunnel progresses. That is, the movable trackway moves forward as the tunnel is constructed. To the rear of the trackway conventional ties and rails are then installed on the tunnel floor and form a continuous track from the interior to the exterior of the tunnel to provide a support for the tunneling apparatus, for the vehicles which remove the dirt and debris, and for the equipment which is used to drill, blast and otherwise construct the tunnel. The movable trackway can also serve to support rubber tired equipment where such is employed.

However, even with this improvement there still remains the long section of tunnel between the working end and the exterior wherein the trackways are laid directly on the rough tunnel floor or the equipment is supported directly on the tunnel floor. This tunnel floor does not provide a sturdy and suitable support for the tracks and equipment. Where tracks are employed, realignment of the tracks and continuous inspection is necessary to maintain the trackway in good repair. Similarly, the floor of the tunnel must be continuously maintained in those instances where rubber vehicled equipment is employed.

It is an object of the present invention to provide a method of tunneling in which precast concrete slabs are laid on the floor of the tunnel to form a firm floor for supporting tracks or for supporting rubber tired equipment.

It is another object of the present invention to provide a precast concrete slab to be placed in the tunnel invert which serves to support the tracks for tunneling equipment or rubber tired tunneling equipment and which also serve as strut for the tunnel ribs.

It is still a further object of the present invention to provide a method wherein as tunneling progresses the slabs are continuously installed at the tunnel face so that a firm floor is provided as the tunnel progresses.

The foregoing and other objects are achieved by a method of tunneling in which a moving floor is employed at the tunnel face to support the tunneling equipment comprising the successive steps of advancing the moving floor and placing precast floor slabs across the tunnel on the excavated tunnel invert exposed by the moving floor whereby to provide a floor along the length of the tunnel.

The invention will be more clearly understood from the following description taken in connection with the accompanying drawings in which:

FIG. 5 is an enlarged perspective view showing a plurality of slabs disposed one adjacent to the other shown in place for supporting ties.

FIG. 6 is a sectional view showing another type of precast concrete slab.

FIG. 7 is a sectional view showing precast slabs including two sections.

FIG. 8 shows the slabs in accordance with the present invention in connection with a tunnel in which the floor is provided with a gravel bed.

FIG. 9 is a cross-sectional view taken along the line 9—9 of FIG. 8.

Figure 1:
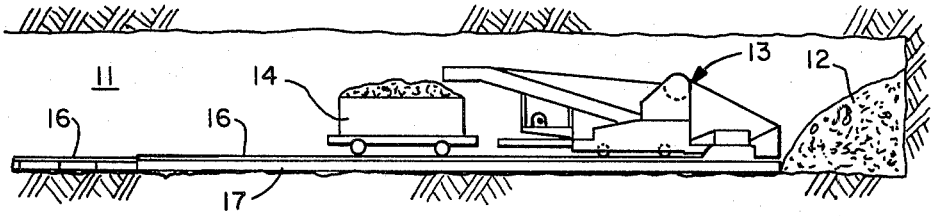
FIG. 1 is an illustrative sectional view showing a sliding floor and so-called mucking equipment for removing the debris dislodged from the interior of the tunnel by the tunneling, drilling and blasting.

Referring now to FIG. 1 there is shown a tunnel 11 with rock, dirt and other material 12 dislodged from the forward end of the tunnel. Suitable mucking equipment 13 serves to remove the dirt and debris from the front end of the tunnel and deliver the same onto a muck car 14 which is adapted to ride upon track 16. In this example the front section of rails are supported upon a moving floor 17 which includes means for switching equipment from one track to another at the tunnel face as mucking proceeds. Motive means such as a diesel powered engine move the muck cars along the tracks 16 to the exterior of the tunnel. It is, of course, apparent to one skilled in the art that rubber tired loaders and carriers may be employed.

Figure 2:
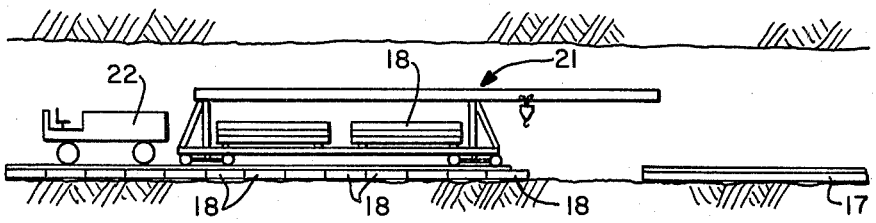
FIG. 2 is a sectional view showing apparatus suitable for installing slabs in accordance with this invention as tunneling progresses and moving floor moves forward to provide a firm floor for the rails.

In accordance with the present invention, as the sliding floor moves forward precast concrete slabs 18 are placed on the floor of the tunnel, FIG. 2. The slabs are adapted to receive sections of rail so that as tunneling progresses, slabs are continuously placed and there is provided a firm floor for supporting the tracks; or, in those instances where rubber tired equipment is used in the tunneling operation, for supporting the rubber tired equipment. In FIG. 2 the subinvert slabs 18 are shown on a slab car 21 having an engine 22 for moving a slab car into position whereby a slab can be removed from the car rotated cross-wise of the tunnel and placed on the tunnel floor adjacent to the preceding slab. Preferably, the slab is placed on a movable steel plate 23 which serves to initially support the slab so it can be placed in a cooperative relationship with the adjacent slab and as the traveling floor moves forward, the slabs are allowed to engage the uneven floor of the tunnel.

Figure 3:
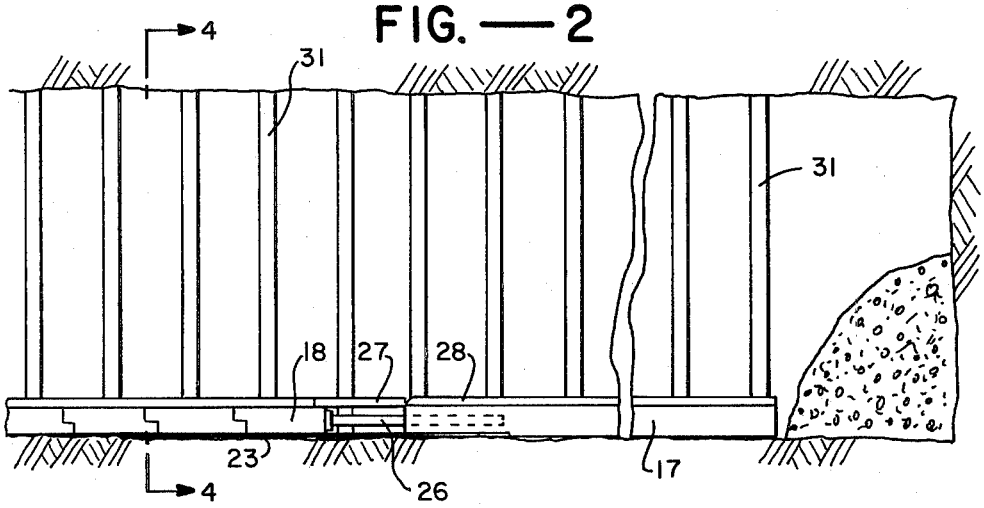
FIG. 3 is an enlarged sectional view schematically showing the moving floor and the slabs placed together with ties and rails supported thereon.

Referring now more particularly to FIG. 3, there is shown an enlarged view of the tunnel with the traveling floor 17 being driven forward by means of a hydraulic jack 26 operating against the forwardmost slab 18. As the floor moves forward, rail 27 attached to the existing rail moves outwardly from is telescoped position within the enlarged rail portion 28 carried by the moving floor. After the floor has advanced a predetermined distance, the slab car is brought into the tunnel, the hydraulic jack is retracted and the slabs are laid upon the steel plate 23 and lap one another as shown to form the solid flooring. Thereafter, steel ties 25 are placed in the grooves 26 formed in the slabs, FIG. 5, and tied down by suitable fastenings which are threadedly received by the threaded holes 28 formed at the bottom of the grooves in each of the slabs. The threaded holes also provide means for lifting the slabs to put them in place. Rails 29 are then suitably secured to the ties to form the track.

Figure 4:
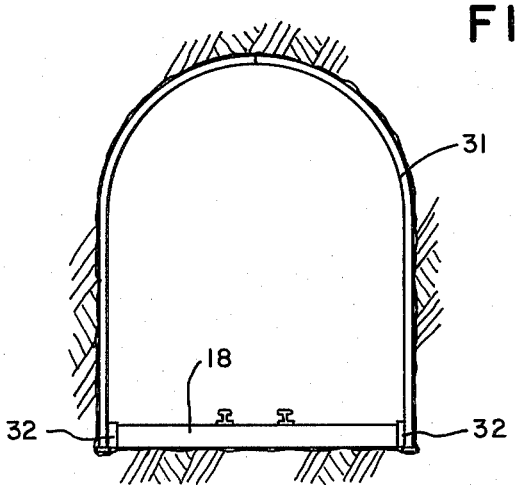
FIG. 4 is a sectional view taken generally along the line 4—4 of FIG. 3 and showing the slabs serving as struts for the steel support ribs which support the walls of the tunnel.

In addition, the slabs extend the width of the tunnel as shown in FIG. 4 and are adapted to act as struts for the bottom of the tunnel ribs 31. As shown, blocking 32 is placed between the ends of the slabs 18 and the ribs 31 to securely hold the same to prevent dirt from urging the ribs inwardly under the earth's weight and pressure. In the example shown, the joints between slabs are keyed. However, it is to be understood that the slabs may be of rectangular shape and placed closely adjacent to one another as shown in FIG. 6. If the underflooring is not solid, then holes 34 formed in the slabs provide means for injecting grout beneath the slabs to provide an even, firm support for the slabs.

In wide tunnels it may be necessary to form the slabs in two sections with a longitudinal joint 36 such as shown in FIG. 7 wherein the slab is in two sections with a keyed center joint to provide for the proper span across the tunnel floor.

It is seen that as tunneling progresses and as the slabs are laid, there is a solid flooring throughout the length of the tunnel. This flooring may be later used as the floor of the tunnel with concrete applied to the sidewalls to form a smooth walled tunnel.

In certain applications where the flooring of the tunnel or sections of the floor are loose dirt, it may be desirable to provide a gravel base prior to laying the slabs. In such instances, a gravel box 41, FIGS. 8 and 9, having a plurality of sections is placed on the floor and filled with the gravel 42. Then the invert slabs are placed thereon as shown in FIGS. 8 and 9 wherein the gravel box 41 is shown with a longitudinal steel runner 43 and flat cross-bars 44. The invert slabs are placed on the box and serve as struts and as the flooring.

Thus, it is seen that there has been provided an improved method for tunneling in which a solid floor is continuously laid as tunneling progresses. The slabs are of unique design adapted to support equipment and provided with means for hoisting and placing the slabs in place and for accommodating rail ties. The system provides for a solid footing for the equipment throughout the construction of the tunnel. In use of such a flooring, the rails can be kept aligned preventing movement in the support system when there is very rough ground. In faulted mountains this is a very important consideration.

What is claimed is:

1. The method of providing a flooring in a tunnel of the type in which a moving floor is employed at the tunnel face to support the tunneling equipment which comprises the steps of providing the moving floor with a flat, horizontally extending support surface extending rearwardly therefrom at floor level and movable therewith, advancing the moving floor and support surface, and placing precast concrete floor slabs to extend across the tunnel on the excavated tunnel invert exposed by the moving floor whereby to provide flooring along the length of the tunnel, each of said slabs being initially placed, one at a time, onto said support surface and adjacent the previous slab while remaining on said surface, and thereafter from said surface onto said tunnel invert as said moving floor and support surface are advanced wherein said equipment is supported on rails, said method including the additional step of mounting rails on the floor slab to provide a continuous track.

2. A method as in claim 1 including the additional step of injecting grout between the tunnel invert and the slabs after the slabs have been placed on the tunnel floor.

3. The method of providing a flooring in a tunnel of the type in which a moving floor is employed at the tunnel face to support the tunneling equipment which comprises the steps of providing the moving floor with a flat, horizontally support surface extending rearwardly therefrom at floor level and movable therewith, advancing the moving floor and said support surfaces, placing wall and ceiling support ribs in the excavated tunnel at spaced intervals, placing precast concrete floor slabs to extend across the tunnel on the excavated tunnel invert exposed by the moving floor by first placing each successive slab onto said support surface and against the previous slab while thereon and thereafter causing the slab to move off of the support surface and onto the tunnel invert by advancing the moving floor and said surface whereby to provide a support floor for the tunneling equipment along the length of the tunnel, and placing support blocks between slab ends and the ribs to restrain inward movement of the ribs.

4. A method as in claim 3 wherein said equipment is supported on rails including the additional steps of mounting rails on the floor slabs to provide a continuous track.

5. A method as in claim 3 including the additional step of supporting said slabs on a firm surface when they are initially placed on the excavated tunnel invert and moving the surface to allow the slabs to contact the floor.

6. A method as in claim 3 including the additional step of injecting grout between the tunnel invert and the slab to provide additional support for said slab.

7. A method according to claim 1 including the step of providing said moving floor with means for pushing against the slab most recently placed on said support surface for causing a moving floor and support surface to advance.

8. A method according to claim 3 including the step of providing said moving floor with means for pushing against the slab most recently placed on said support surface for causing a moving floor and support surface to advance.

* * * * *